US012369669B2

(12) United States Patent
Ketterer et al.

(10) Patent No.: US 12,369,669 B2
(45) Date of Patent: Jul. 29, 2025

(54) SYSTEMS AND METHODS FOR PROVIDING RELIABLE HELMET SUSPENSION INSTALLATION

(71) Applicant: MSA Technology, LLC, Cranberry, PA (US)

(72) Inventors: Kevin R. Ketterer, Portersville, PA (US); David J. Losos, Evans City, PA (US); John F. Rihn, Glenshaw, PA (US); Maxwell R. Naar, Doylestown, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 170 days.

(21) Appl. No.: 17/897,283

(22) Filed: Aug. 29, 2022

(65) Prior Publication Data

US 2024/0065362 A1 Feb. 29, 2024

(51) Int. Cl.
*A42B 3/14* (2006.01)

(52) U.S. Cl.
CPC ..... *A42B 3/14* (2013.01)

(58) Field of Classification Search
CPC ..... A42B 3/14; A42B 3/142; A42B 3/145; A42B 3/147
See application file for complete search history.

(56) References Cited

U.S. PATENT DOCUMENTS 2,758,305 A * 8/1956 Gross ..... A42B 3/14 2/416
2,855,605 A * 10/1958 Aileo ..... A42B 3/14 2/419
2,858,538 A * 11/1958 Simpson ..... A42B 3/14 2/416
2,946,063 A * 7/1960 Boyer ..... A42B 1/10 2/418
3,026,523 A * 3/1962 Bowers, Sr. ..... A42B 3/14 2/416
3,083,371 A * 4/1963 Austin ..... A42B 3/14 2/419

(Continued)

FOREIGN PATENT DOCUMENTS

GB 2402319 A 12/2004
JP 2016-79518 A 5/2016

(Continued)

OTHER PUBLICATIONS

Patent Cooperation Treaty, PCT/US2022/041816, International Search Report and Written Opinion, Jan. 26, 2023.

*Primary Examiner* — Alissa L Hoey
(74) *Attorney, Agent, or Firm* — Jones Day

(57) ABSTRACT

Systems and methods are provided a helmet that includes shell comprising a plurality of connection receptacles, a first connection receptacle having a shape that is different from a shape of a second connection receptacle. A flexible suspension web includes a plurality of straps for supporting the shell on a head of a wearer, each of the straps including a connection tab, where a first connection tab, which is associated with a first strap, has a shape corresponding to the shape of the first connection receptacle, and where a second connection tab, which is associated with a second strap, has a shape corresponding to the shape of the second connection receptacle.

23 Claims, 14 Drawing Sheets

(56) References Cited

U.S. PATENT DOCUMENTS 2,585,937 A * 2/1965 Johnson ..... A42B 3/14 2/420
3,192,536 A * 7/1965 Benner ..... A42B 3/14 2/418
3,223,086 A * 12/1965 Denton ..... A62B 18/04 128/201.24
3,268,911 A * 8/1966 Cox ..... A42B 3/14 D2/882
3,388,405 A * 6/1968 Simpson ..... A42B 3/142 2/418
3,422,459 A * 1/1969 Bowers, Jr. ..... A42B 3/14 2/416
3,555,560 A * 1/1971 Rascke ..... A42B 3/14 2/418
3,909,846 A * 10/1975 Zahn ..... A42B 3/14 2/416
3,935,044 A * 1/1976 Daly ..... B29C 44/3426 428/319.3
4,035,847 A * 7/1977 Prince ..... A42B 3/14 2/416
4,055,860 A * 11/1977 King ..... A42B 3/14 2/416
4,463,456 A * 8/1984 Hanson ..... A42B 3/14 2/416
4,888,831 A * 12/1989 Oleson ..... A42B 3/145 24/581.1
4,920,578 A * 5/1990 Janzen ..... A41D 13/1236 2/114
5,609,569 A * 3/1997 Offenhartz ..... A61F 13/146 602/61
5,619,754 A * 4/1997 Thurwanger ..... A42B 3/085 2/418
5,996,126 A * 12/1999 Barthold ..... A42B 3/14 2/416
6,081,931 A 7/2000 Burns et al.
6,609,254 B2 * 8/2003 Bielefeld ..... A42C 2/002 2/416
7,043,772 B2 * 5/2006 Bielefeld ..... A42B 3/145 2/418
7,213,271 B1 * 5/2007 Bielefeld ..... A42B 3/145 2/416
7,305,716 B1 * 12/2007 Richards ..... A41D 13/1245 2/121
9,113,671 B2 * 8/2015 Pfanner ..... A42B 3/14
9,713,355 B2 * 7/2017 Daoust ..... A42B 3/127
9,737,107 B2 * 8/2017 Xiong ..... A42B 3/142
9,949,522 B2 * 4/2018 Ketterer ..... A42B 3/324
10,238,163 B2 * 3/2019 Jacobsen ..... A42B 3/08
10,244,811 B2 * 4/2019 Xiong ..... A42B 3/147
11,819,142 B2 * 11/2023 Crystal ..... A47D 13/02
2008/0229488 A1 * 9/2008 Kim ..... A42B 3/12 264/250
2009/0119959 A1 * 5/2009 Brown ..... G09B 19/0076 2/243.1
2014/0101828 A1 * 4/2014 Sugerman ..... A42B 3/085 2/418
2014/0317822 A1 * 10/2014 Friedman ..... A44B 17/0082 2/69
2015/0000671 A1 1/2015 Frerichs et al.
2015/0059066 A1 3/2015 Ketterer et al.
2015/0265453 A1 * 9/2015 Bieber ..... A61F 5/3738 602/4
2016/0249701 A1 9/2016 Xiong et al.
2019/0166944 A1 * 6/2019 Mini Townson ..... A42B 3/127
2021/0330018 A1 * 10/2021 Yarlagadda ..... A42B 3/064
2022/0054325 A1 * 2/2022 Yasinov ..... A61B 17/3468
2023/0240392 A1 * 8/2023 Lucas ..... A41D 15/002 2/69
2023/0263272 A1 * 8/2023 Schwager ..... A41D 13/0568 24/593.1
2024/0032640 A1 * 2/2024 Losos ..... A42B 3/324
2024/0049826 A1 * 2/2024 Cooper ..... A42B 3/28

FOREIGN PATENT DOCUMENTS

WO WO-2012104572 A1 * 8/2012 ..... A42B 3/14
WO WO-2015166598 A1 * 11/2015 ..... A42B 3/062
WO 2018215083 A1 11/2018

* cited by examiner e.g., all connection tabs 108 are of a different shape

SYSTEMS AND METHODS FOR PROVIDING RELIABLE HELMET SUSPENSION INSTALLATION

BACKGROUND

Helmets are a common form of protective gear for the head, protecting the human brain. Helmets have a wide range of applications ranging from recreational, to construction, to combat, to safety and rescue (e.g., full brimmed fire helmets). Helmets are often constructed in portions, where an inner helmet interfaces with a wearer's head and provides some level of protection, such as via padding applied to the outside of the inner portion to provide shock absorption. An outer shell, often having a hard outward facing surface, provides additional protection, such as providing further shock absorption as well as helmet penetration prevention.

SUMMARY

Systems and methods are provided for a helmet that includes shell comprising a plurality of connection receptacles, a first connection receptacle having a shape that is different from a shape of a second connection receptacle. A flexible suspension web includes a plurality of straps for supporting the shell on a head of a wearer, each of the straps including a connection tab, where a first connection tab, which is associated with a first strap, has a shape corresponding to the shape of the first connection receptacle, and where a second connection tab, which is associated with a second strap, has a shape corresponding to the shape of the second connection receptacle.

In another example, a method of operating a helmet includes attaching an outer shell to an inner liner and connecting a flexible suspension web comprising a plurality of straps to the inner liner via connection tabs, each of the straps being associated with a connection tab, where a release mechanism of the connection tabs is inaccessible when the outer shell is attached to the inner liner. The outer shell is disconnected from the inner liner, and the flexible suspension web is disconnected from the inner liner after the outer shell is disconnected from the inner liner.

DETAILED DESCRIPTION

Figure 1:
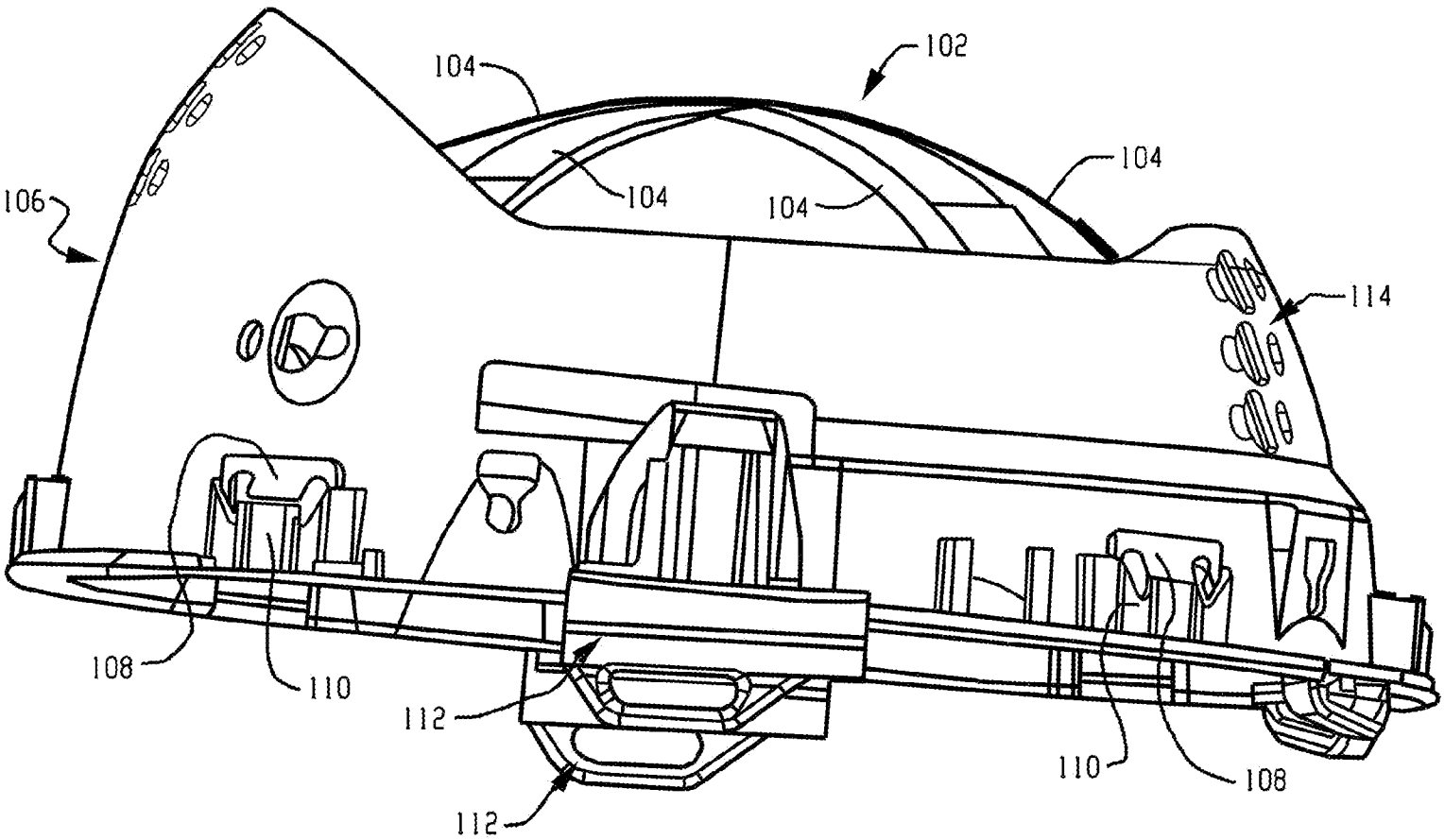
FIG. 1 is a diagram depicting a suspension web integrated with an inner liner of a helmet.

The multi-layer implementation of helmets described above may ease in the manufacturing of helmets, where a hard outer shell can be manufactured separately from an inner helmet that may optimally be made from wholly different materials and be subjected to disparate manufacturing processes. For example, the inner helmet may be fabricated using components and materials and features designed to provide a snug and comfortable fit on the interior. For example, a pliable material, such as fabric formed in the shape of a web (a suspension web) may be integrated with the inner helmet to comfortably position the helmet on the head of the wearer. The suspension web may take a variety of forms including a plurality of straps extending radially from a central point or a mesh, which can take a variety of forms including triangular, square, rectangular, hexagonal. The interior may include other features, such as a shock absorbing material (e.g., Styrofoam, air bladders, vinyl nitryl foam, expanded polypropalene foam) applied to the outer surface of the inner helmet. The outer helmet shell may then be made of a rigid or penetration preventative material, such as Kevlar, carbon fiber, polycarbonate, molded plastics, composite materials, or combinations thereof.

While a multi-layer implementation provides certain advantages, mechanisms for assembling and disassembling the helmet may be cumbersome and time consuming. This can present an inconvenience during maintenance activities, such as cleaning and inspection. Components that can be easily taken apart may be cleaned and inspected regularly, while other components may be less regularly maintained. Increasing ease of cleaning, inspecting, and other servicing of helmets can increase health and safety of the wearers. Further, cumbersome or confusing assembly mechanisms can result in incorrect installation of helmet components (e.g., incorrect installation of a suspension web resulting in an improperly fitting helmet), which can provide significant safety issues in addition to frustration and disincentive to clean and maintain the helmet properly.

Systems and methods provided herein, in embodiments, provide simple and fast connection of a helmet shell (e.g., a helmet shell comprising an inner liner and an outer shell) and a flexible suspension web. Connection may be accomplished using connection tabs and corresponding connection receptacles that include guides (e.g., shape, color) that promote proper installation of the suspension web to the helmet shell. In embodiments, disconnection of the suspension web from the helmet shell may require disassembly of other components of the helmet shell, so as to increase the likelihood of proper maintenance of those other components. For example, disconnection mechanisms for removing the suspension web from the shell may be positioned between other components of the shell, such that the disconnection mechanisms are inaccessible or difficult to access without further disassembly of the shell. Because users may be inclined to regularly remove the suspension web from the helmet (e.g., for cleaning and hygiene purposes, to replace worn materials), requiring further disassembly of the shell to facilitate disconnection of the suspension web may encourage more complete disassembly, cleaning, and component inspection of the helmet.

Figure 2:
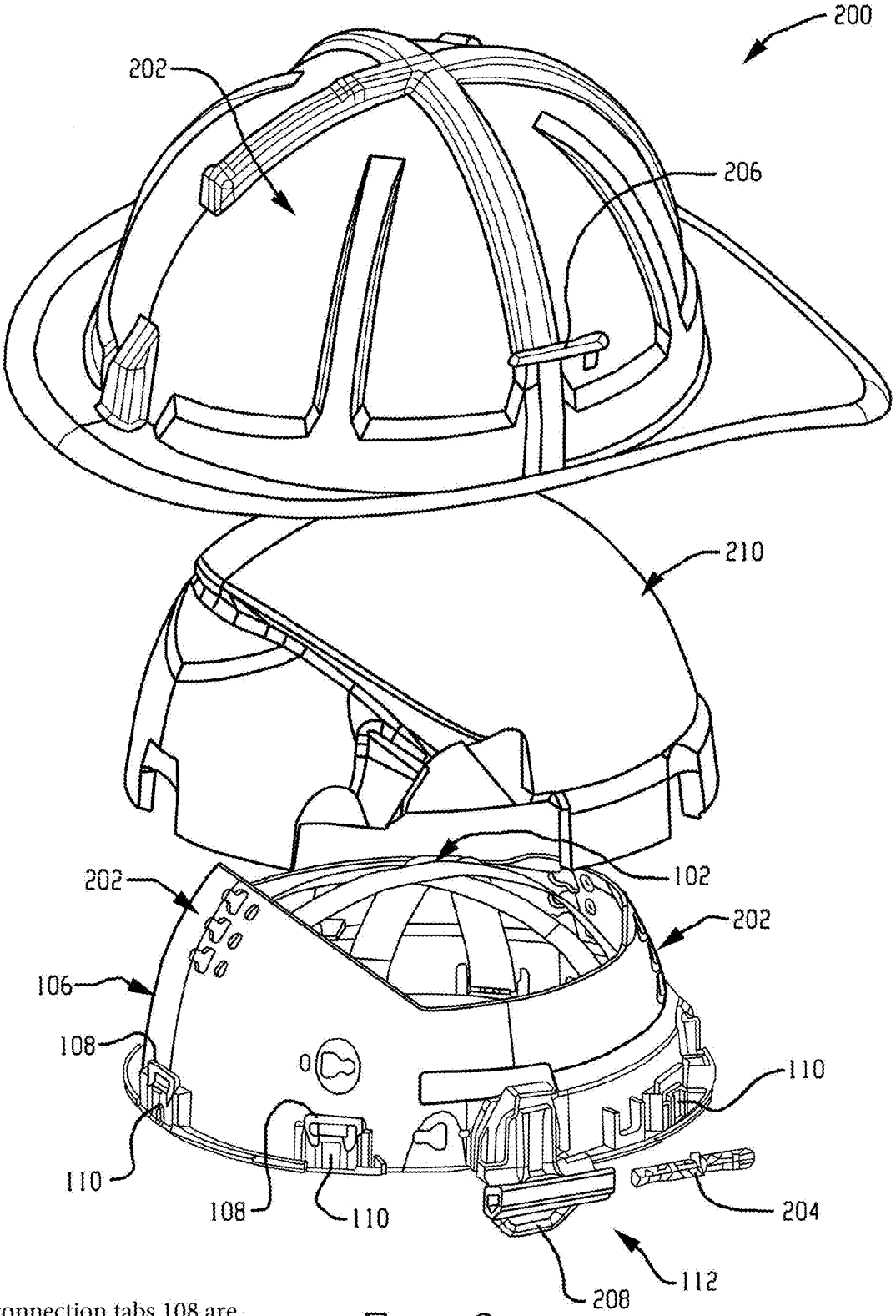
FIG. 2 is a diagram depicting a full brimmed fire helmet outer shell being integrated with an inner liner.

FIG. 1 is a diagram depicting a suspension web integrated with an inner liner of a helmet. The suspension web 102 comprises a plurality of straps 104 that support the helmet shell (e.g., inner liner 106 and an outer shell as depicted in FIG. 2) on the head of a wearer. The suspension web 102 is connected to the inner liner 106 via a set of connection tabs 108 and corresponding connection receptacles 110. In the example of FIG. 1, each suspension web strap 104 includes a connection tab 108 at its end. The inner liner 106 includes receptacles 110, each configured to receive a connection tab 108 and hold it in place, thus securing the suspension web 102 to the inner liner 106. In embodiments, and as described further herein, the connection tab 108 may include a body portion that interfaces with the connection receptacle 110 to hold the connection tab 108 in the connection receptacle 110 until a user performs a disconnection manipulation (e.g., pressing a deformable biased member to allow the connection tab 108 to pass back through the connection receptacle 110). In embodiments, the inner liner 106 may include other features, such as outer shell connection mechanisms 112 for securing an outer shell (e.g., a hard full brimmed fire helmet, a full brim construction helmet, a cap style construction helmet, a soft shell (e.g., leather) outer shell). The inner liner 106 may further include attachment points 114 for facilitating connection of other helmet accessories, such as a headband assembly for maintaining a proper helmet pitch on a wearer via interaction with the nape of a user's neck.

FIG. 2 is a diagram depicting a full brimmed fire helmet outer shell being integrated with an inner liner. The shell 200 includes an outer shell 202 that in this example takes the form of a full brimmed fire helmet. The outer shell 202 is secured to an inner liner 106, with an intermediate shell 210 (e.g., a shell made of hard, crush-resistant plastic) sandwiched therebetween. That connection is facilitated by one or more (1, 2, 3, 4, or more) mounting assemblies 112 (e.g., one on each side of the helmet). Mounting assemblies 112 may take a variety of forms, such as an anchor 206 that passes through the outer helmet shell 202 via one or more through holes, where the extending portion is received by a mounting portion 208, which may take the form of a structure integrated with the inner liner 106 (e.g., a plastic structure molded with other structure of the inner liner 106). A locking slider 204 is configured to slide into the mounting portion 208 such that it retains the extending portion of the anchor 206 within the mounting portion 208 when the locking slider 204 is in the engaged position.

The helmet 200, deconstructed in FIG. 2, includes an outer shell 202, an intermediate shell 210, and an inner liner 106. In the example of FIG. 2, the inner liner 106 is formed of a first material and includes a suspension web 102 for supporting the helmet 200 on the head of a wearer. In embodiments, a layer of shock absorbing materials may be applied to the outside of the inner liner 106 to provide spacing and shock absorption.

The inner liner 106 further includes a plurality of connection receptacles 110 for receiving connection tabs 108 of the suspension web 102. In embodiments, access to a portion of the connection tab 108 (e.g., the portion visible in FIG. 2) in a connection receptacle 110 is limited or prevented when the outer shell 202 is integrated with the inner liner 106 (e.g., via connection mechanism 112). For example, because a portion of a connection tab 108 that facilitates disconnection manipulation is sandwiched between the inner liner 106 and the outer shell 202, disconnection of the suspension web 102 from the inner liner 106 may be inhibited when the outer shell 202 is integrated with the inner liner 106. By encouraging disassembly of the outer shell 202 and the inner liner 106 to facilitate suspension web 102 disconnection, cleaning and inspection protocol compliance can be increased.

Figure 3:
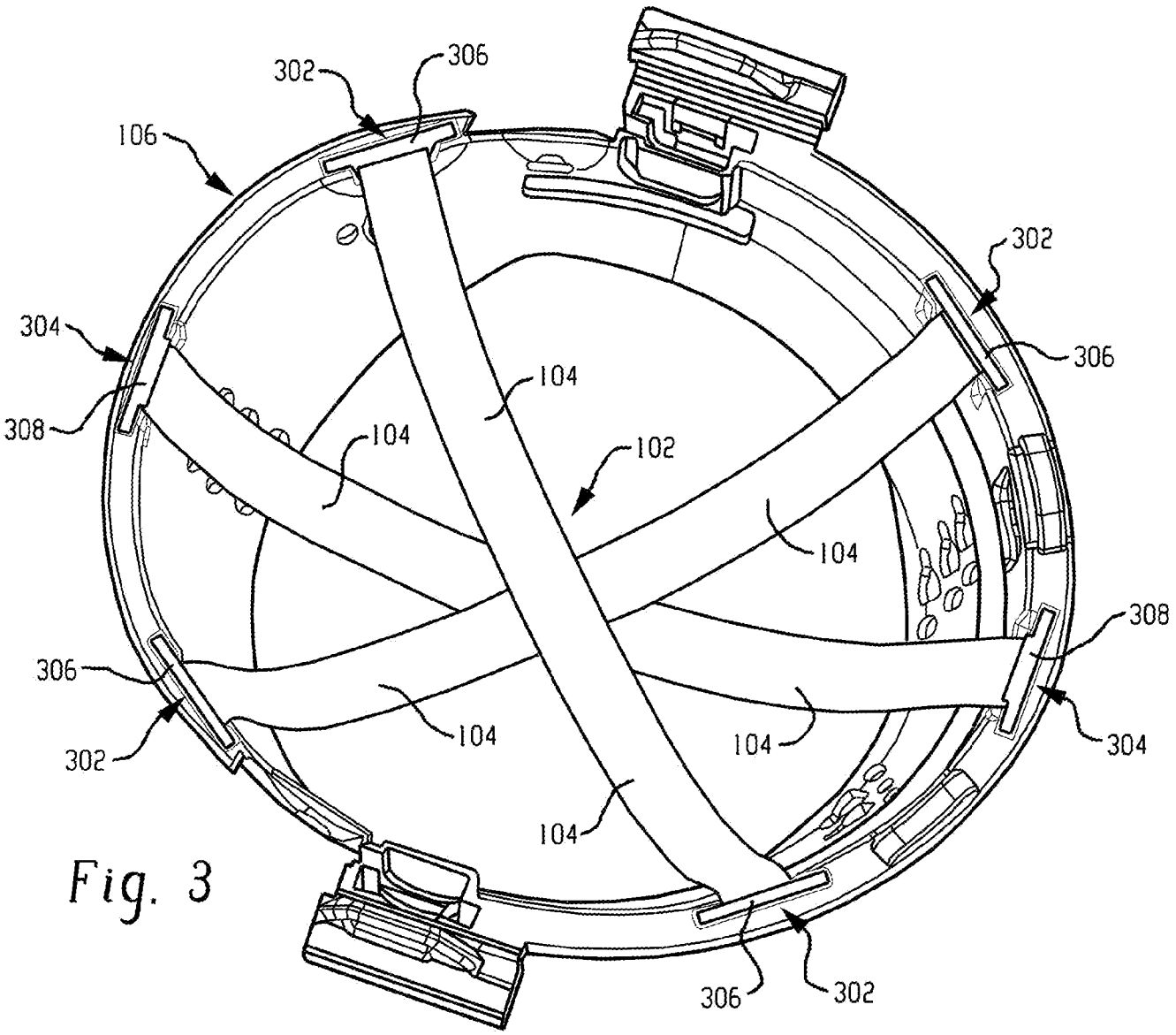
FIG. 3 is a diagram showing a bottom view of an inner liner having a suspension web installed thereon.

FIG. 3 is a diagram showing a bottom view of an inner liner having a suspension web installed thereon. The helmet includes an inner liner 106 that has a plurality of connection receptacles 302, 304 that are configured to receive connection tabs 306, 308 that are associated with straps 104 of a suspension web 102. In FIG. 3, the suspension web 102 comprises six fabric straps 104, each strap having a connection tab 306, 308 connected at its end. In the embodiment of FIG. 3, the receptacles 302, 304 and the connection tabs 306, 308 have two different top shapes. Four of the receptacles 302 have rectangular top shapes that are configured to receive connection tabs 306 that have rectangular top portions. Two of the receptacles 304 have stepped top shapes that are configured to receive connection tabs 308 that have corresponding stepped top portions. The differing shapes of the connection receptacles 302, 304 limits which of the connection tabs 306, 308 may be installed into those respective connection receptacles 302, 304 (i.e., a rectangular connection tab 306 cannot be properly installed into a stepped receptacle 304 (e.g., due to a mismatched length or width); a stepped connection tab 308 cannot be properly installed into a rectangular receptacle 302). This keying of connection tabs 306, 308 to particular receptacles 302, 304 or subsets of receptacles 302, 304 promotes proper installation of the suspension web 102 to the inner liner 106 such that proper fit on a wearer is maintained. This may be important, such as in instances where the straps 104 are not all of uniform length. For example, straps 104 associated with the stepped receptacles 304 at the front and back of the inner liner 106 may be longer than straps 104 associated with the rectangular receptacles 302 at the side of the helmet, where installation of connection tabs 306, 308 into the wrong receptacles 302, 304 would result in an incorrect fit of the helmet on the wearer. Angles between straps 104 may also differ and be designed for particular arrangement in the helmet when installed.

In the example of FIG. 3, the suspension web 102 may be installed into the inner liner 106 in exactly two ways (i.e., in both orientations where stepped connection tabs 308 are positioned within stepped connection receptacles 304). Both of those orientations result in a proper fit due to matched lengths of the straps associated with those connection tabs 308. Thus, the suspension web 102 having n=6 straps 104 can be installed in fewer than n ways (i.e., 2 ways) by installing connection tabs (e.g., in a clockwise or counterclockwise order without crossing straps 104). By utilizing more connection tab—connection receptacle key shapes, the number of possible installation configurations can be changed, such as to limit the possible installations to exactly one arrangement. In one example, each connection tab has a unique shape relative to the other connection tabs of the suspension web.

Figure 4:
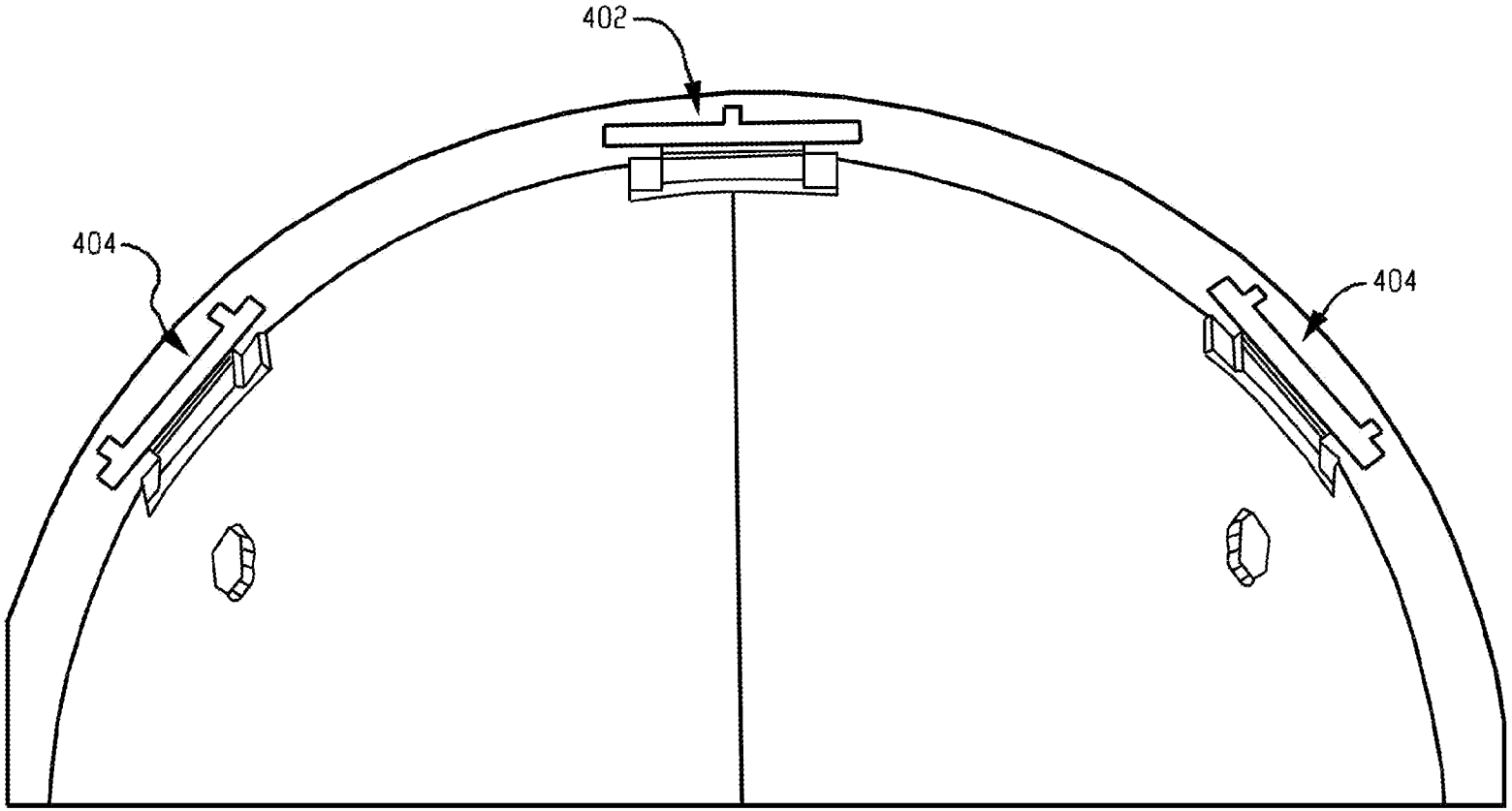
FIG. 4 is a diagram depicting alternate shapes of connection tabs and connection receptacles.
Figure 5:
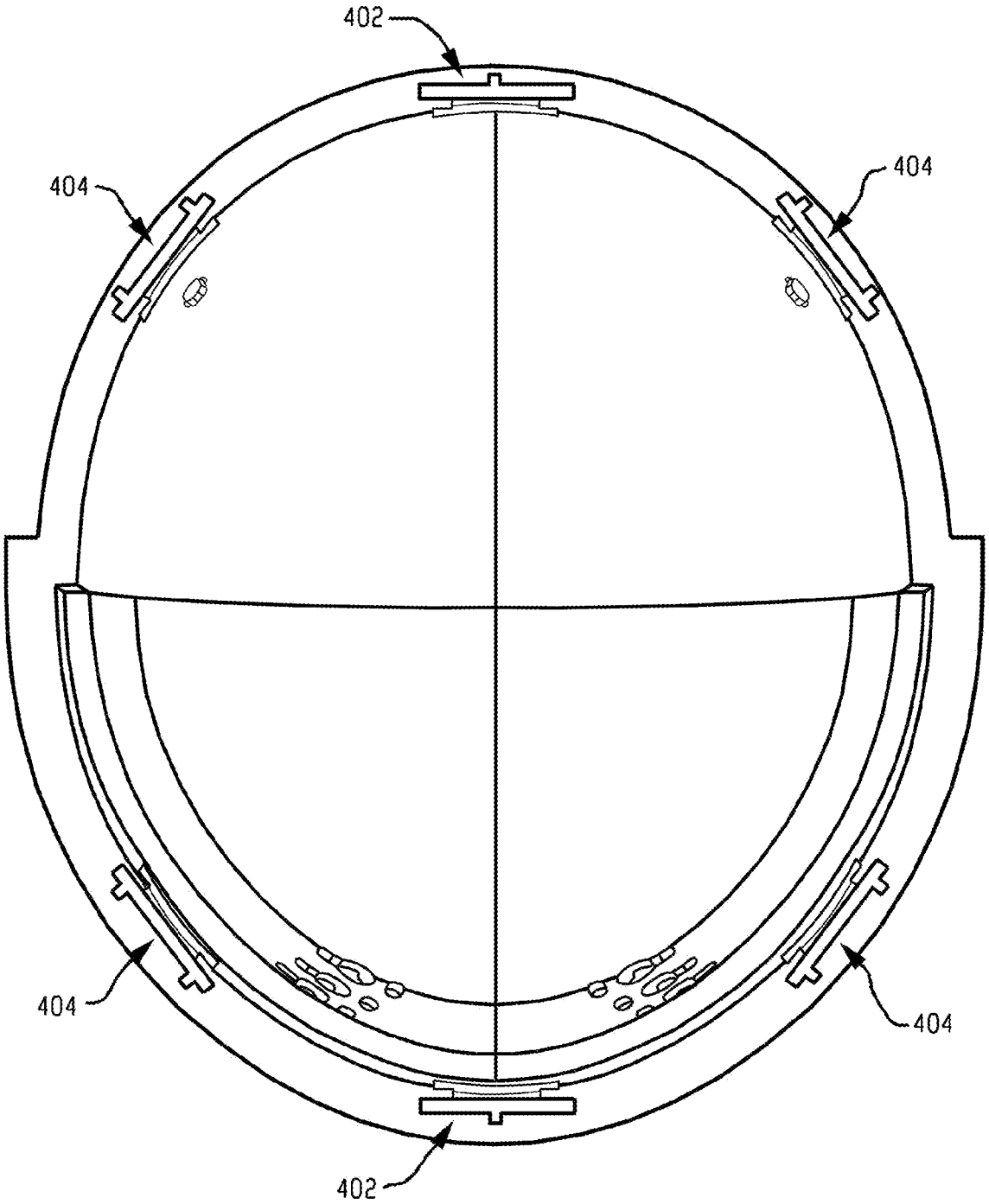
FIG. 5 is a diagram depicting a full set of connection tabs and connection receptacles for a helmet.

Connection tabs and receptacles may take a variety of shapes. FIG. 4 is a diagram depicting alternate shapes of connection tabs and connection receptacles. In the example of FIG. 4, connection tabs and receptacles 402 at the front and back of the inner liner have a first shape that has a single tab protrusion and corresponding receptacle notch. Connection tabs and receptacles 404 at the sides of the inner liner have a second shape that has two protrusions on each tab with corresponding receptacle notches. FIG. 5 is a diagram depicting a full set of connection tabs and connection receptacles for a helmet. FIG. 5 illustrates single-protrusion/notch arrangements 402 at the front and back of the inner liner and two-protrusion/notch arrangements 404 at the side connection locations of the inner liner. FIG. 5 illustrates that in addition to having multiple distinct shapes, that connection tabs may be color coded to aid in ease of installation. In that example, the single-protrusion connection tabs indicated at 402 are colored yellow, where the two-protrusion tabs at 404 are colored orange. In some embodiments, corresponding color indicators (e.g., dots, squares) may be provided on the inner liner near the connection receptacles to aid in efficiency of identifying which connection tabs may be received at a particular connection receptacle.

Figure 6:
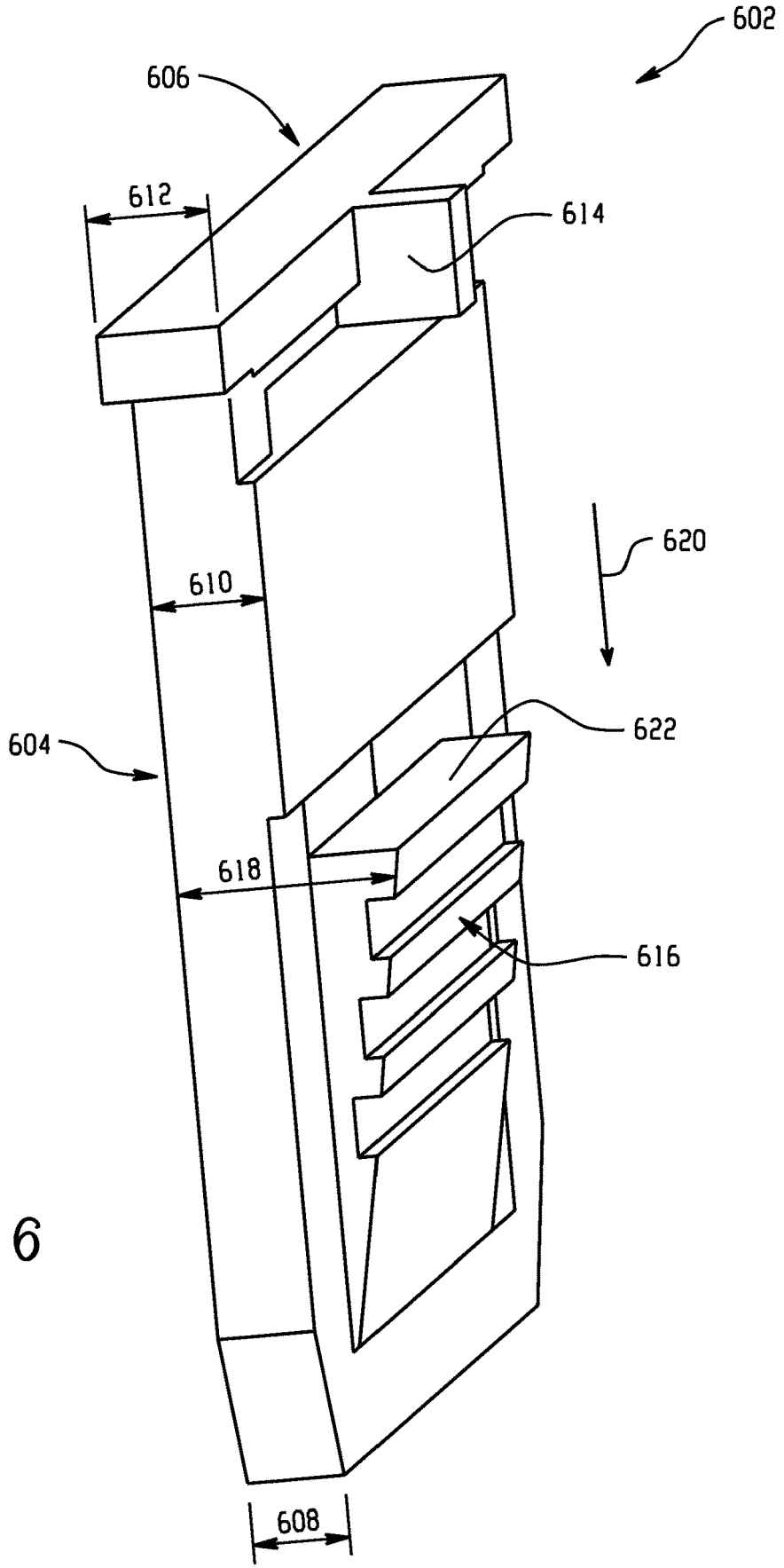
FIG. 6 is a diagram depicting a close up view of a single-protrusion connection tab.

FIG. 6 is a diagram depicting a close up view of a single-protrusion connection tab. The connection tab 602 includes a body portion 604 and a top portion 606. The body portion 604 is configured to hold the connection tab 602 in a corresponding connection receptacle until a user performs a disconnection manipulation of the body portion 604. This can be accomplished via various widths of the connection tab 602 at different positions along its height. In the example of FIG. 6, a tip portion of the connection tab 602 has a narrow width 608. The narrow width 608 may facilitate ease of initial insertion of the connection tab 602 into a connection receptacle. A second portion of the connection tab 602 may have a wider width 610 that interfaces with interior walls of the connection receptacle to provide a snug fit of the connection tab 602 into the corresponding receptacle. The top portion 606 of the connection tab 602 may have an even larger width 612 that may interface with a top portion of the corresponding receptacle (e.g., a lip thereon) so as to prevent the connection tab 602 from being installed further into the connection receptacle than designed. The top portion 606 further includes a first shape (i.e., rectangular with a single protrusion 614) that matches with a top shape of corresponding receptacle.

The body portion 604 further includes a biased member 616 that is configured to hold the connection tab 602 in a connection receptacle. The biased member 616 may be a separate piece that is connected to the main body of the connection tab 602 or may be formed as part of an integral piece (e.g., molded plastic, molded rubber). The biased member 616 is configured, in its resting state as depicted in FIG. 6, to have a width 618 that is larger than width 608, and in some instances larger than width 610. The biased member 616 may be manipulated by being squeezed (e.g., by a user's fingers, by interior walls of a connection receptacle during installation) to reduce the connection tab width at 618 to a narrower width, such as narrow as width 608 when desired. For example, when the connection tab 602 is installed into a connection receptacle in the direction shown at 620, the slanted form of the biased member 616 allows compression of the biased member 616 to a narrowed width until a top 622 of the biased member 616 traverses the span of the connection receptacle. Upon traversing that span, the biased member 616 springs back toward its resting width 618 such that the top 622 of the biased member 616 interfaces with the connection receptacle, holding the connection tab in place. To disconnect the connection tab 602 from a connection receptacle, a user may perform a disconnection manipulation by manually squeezing the biased member 616 (e.g., when an outer shell of a helmet is disconnected from its inner liner having connection receptacles thereon) to allow the top 622 of the biased member 616 to pass back through the connection receptacle until disconnected.

Figure 7:
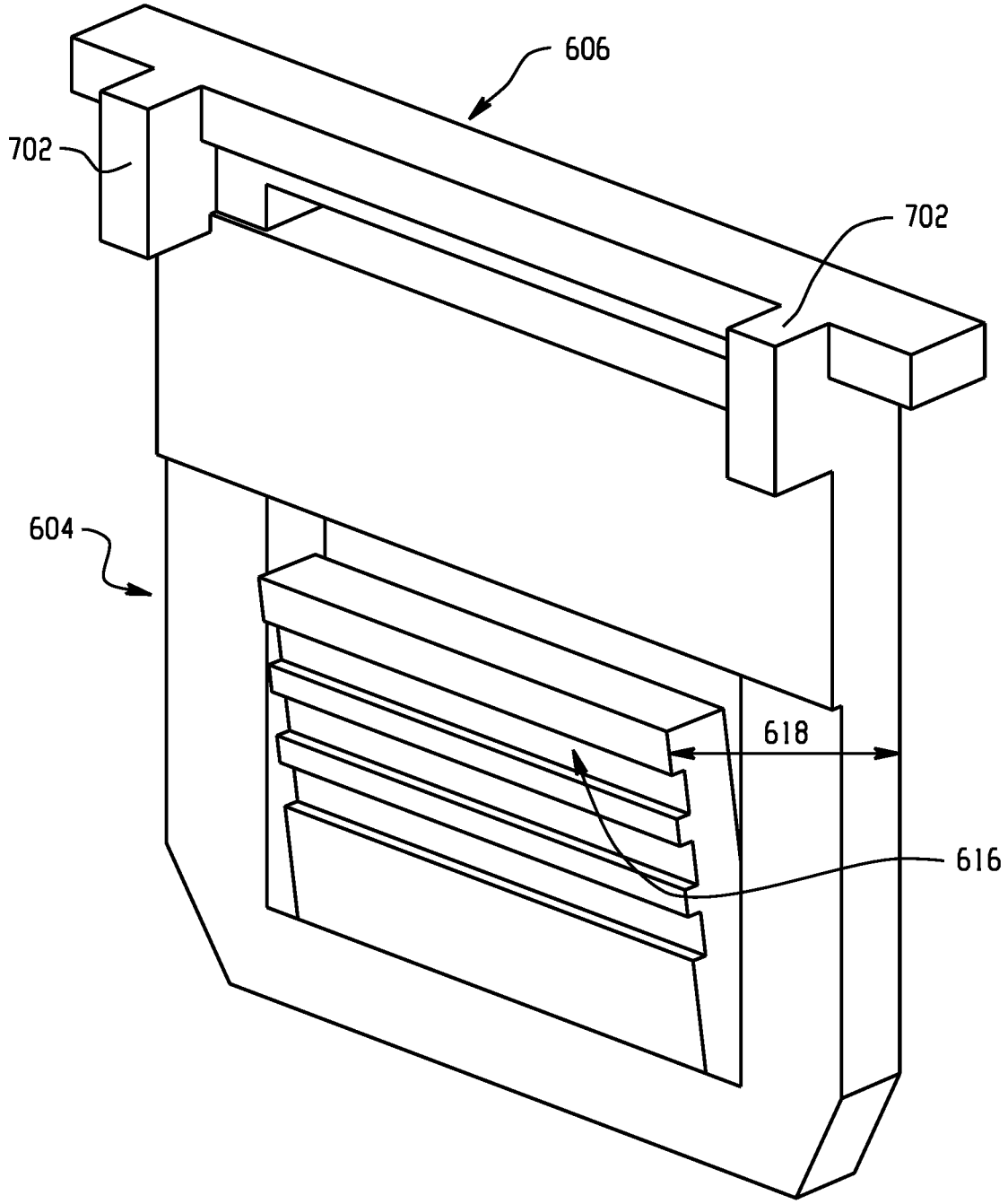
FIG. 7 is a diagram depicting a close up view of a two-protrusion connection tab.

As noted above, top portions of a connection tabs may have differing shapes that facilitated matched installation with appropriate connection receptacles. FIG. 7 is a diagram depicting a close up view of a two-protrusion connection tab. The orange-colored example of FIG. 7 includes several substantially similar features as that of yellow-colored FIG. 6, including a body portion 604 having a biased member 616 that provides a varying width, as well as a top portion 606. While FIG. 6 and FIG. 7 are similar in many respects, the FIG. 7 example differs in that its top portion 606 includes two protrusions 702 giving it a different shape than that of the FIG. 6 example. The alternate top portion shape of FIG. 7 is configured to interface with different connection receptacles than the shape of FIG. 6, ensuring that the connection tab of FIG. 7 is installed in an appropriate helmet shell connection receptacle.

Figure 8:
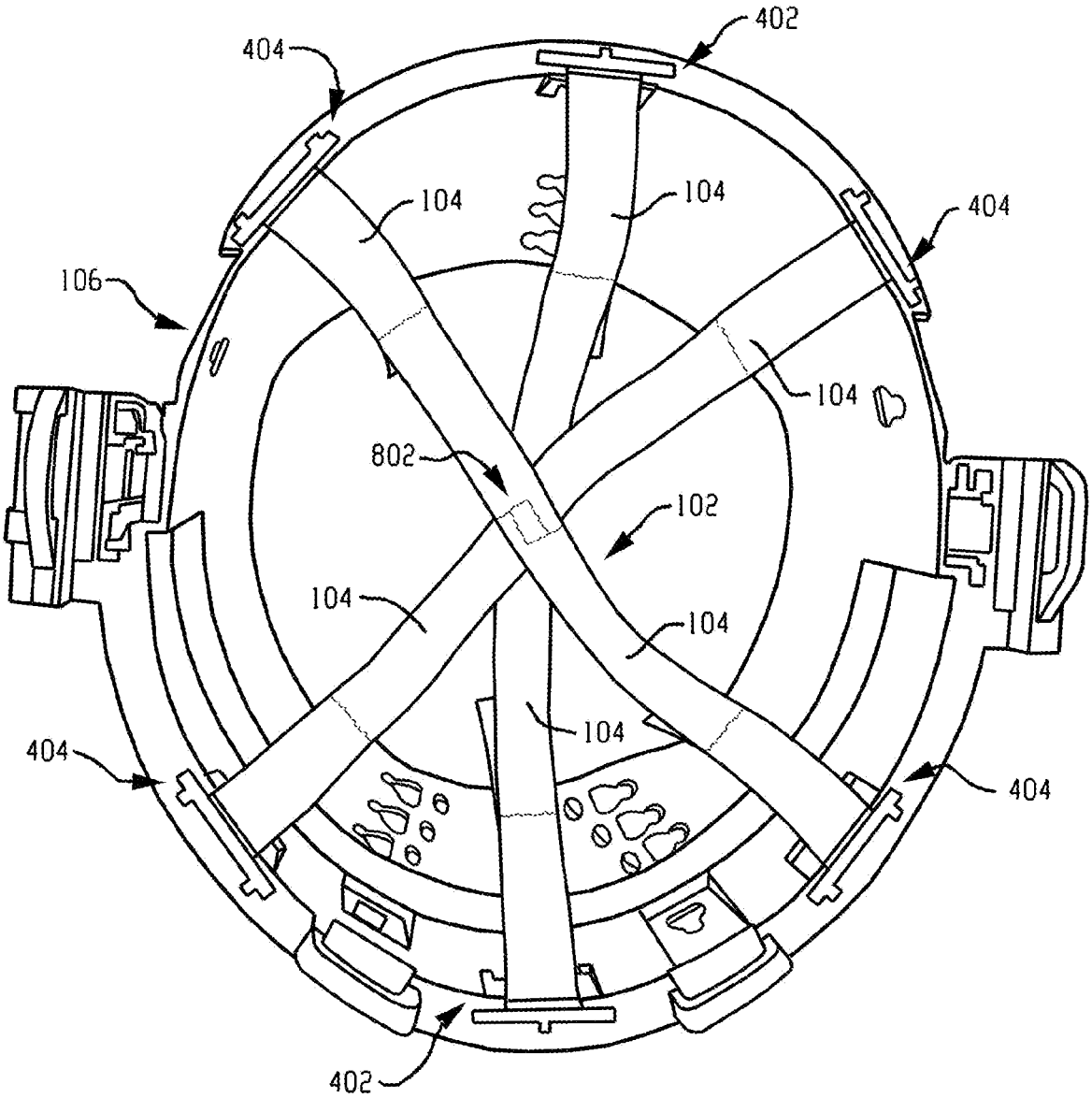
FIG. 8 is a diagram depicting a suspension web installed into an inner liner of a helmet shell.
Figure 9:
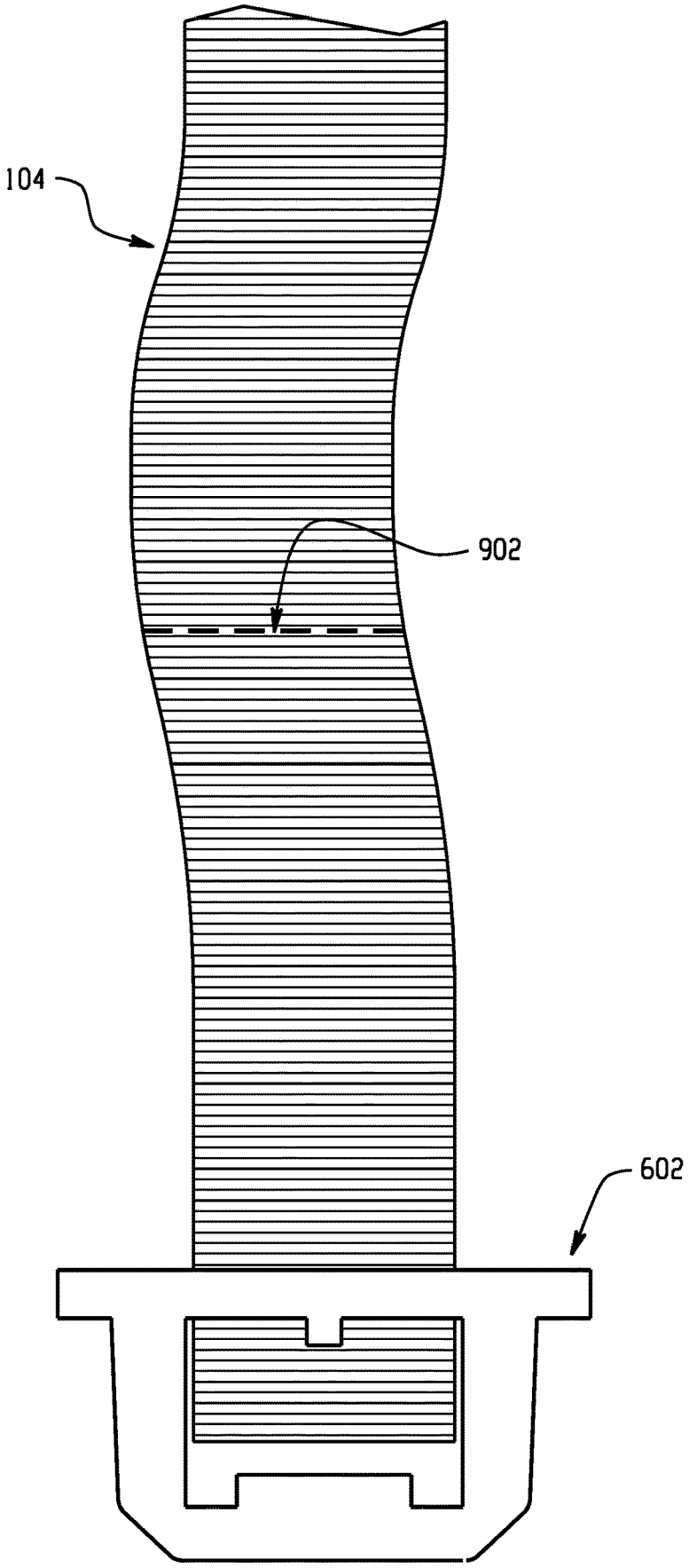
FIG. 9 is a diagram that illustrates example attachment of a suspension web strap with a connection tab.

FIG. 8 is a diagram depicting a suspension web installed into an inner liner of a helmet shell. As described above, the inner liner 106 includes connection receptacles 402, 404 having disparate shapes for receiving particularly shaped connection tabs. The suspension web 102 includes six straps 104, each of the straps having a connection tab connected at its end. Two of the straps 104 have connection tabs configured for connection at connection receptacles 402, while four of the straps 104 have connection tabs configured for connection at connection receptacles 404. In the example of FIG. 8, the straps 104 associated with connection receptacles 402 are longer (e.g., 10% longer, 25% longer) than the straps 104 associated with connection receptacles 404. The six straps 104 are formed from three lengths of fabric material that are sewn together at a substantially central point 802. In other embodiments, each of the six straps 104 may be formed of a individual piece of fabric material, with the six pieces of fabric being connected together at 802. FIG. 9 illustrates example attachment of a suspension web strap 104 with a connection tab 602, where the connection tab 602 includes spaces for the strap 104 to be threaded through and sewn at 902 to itself so as to maintain the connection between the connection tab 602 and the strap 104.

Figure 10:
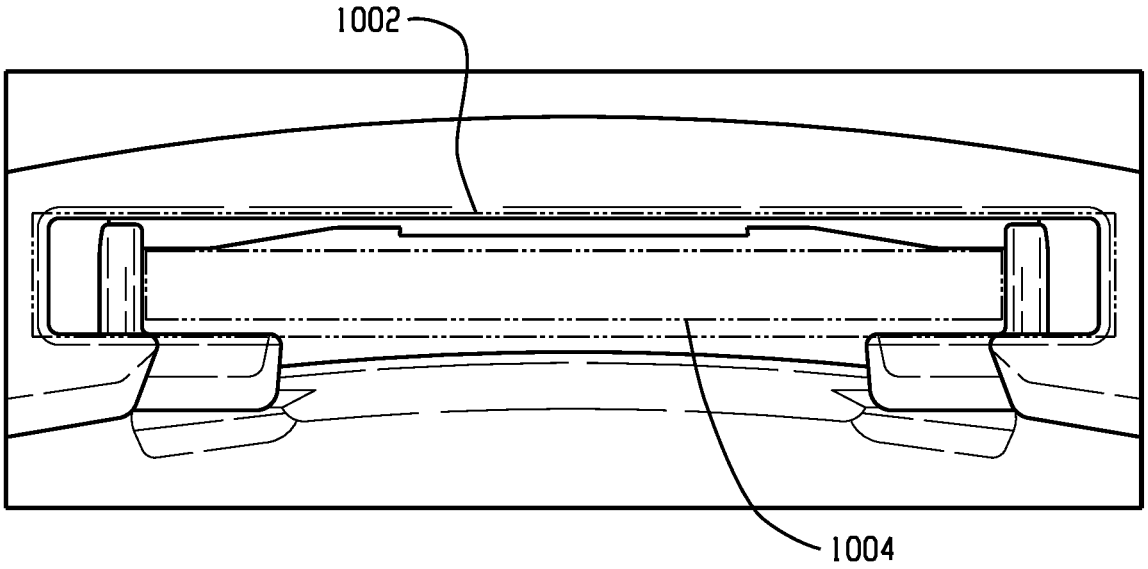
FIG. 10 is a diagram depicting a molded connection receptacle that has a rectangular shape at its top portion and a rectangular shape at its body portion.
Figure 11:
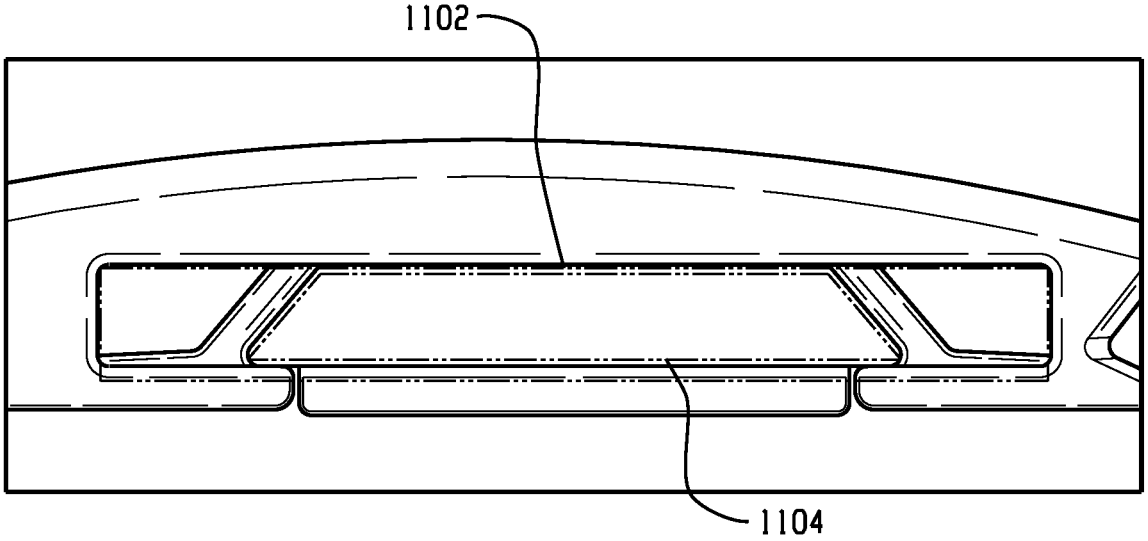
FIG. 11 is a diagram depicting a molded connection receptacle that has a rectangular shape at its top portion and a trapezoidal shape at its body portion.

In the above examples, the connection receptacles have been configured to match a shape of top portions of corresponding connection tabs. Connection receptacles may be matched with connection tabs in other ways as well. For example, connection receptacles may have an interior shape that is configured to match a shape of a body portion 604 of a connection tab. FIG. 10 is a diagram depicting a molded connection receptacle that has a rectangular shape 1002 at its top portion and a rectangular shape at its body portion 1004. The connection receptacle of FIG. 10 is configured to receive a connection tab having a rectangular shape at both its top portion and body. In contrast, FIG. 11 is a diagram depicting a molded connection receptacle that has a rectangular shape 1102 at its top portion and a trapezoidal shape at its body portion 1104. The connection receptacle of FIG. 11 is configured to receive a connection tab having a rectangular shape at its top portion and a trapezoidal shape at its body portion, such that a connection tab that could be installed in the FIG. 10 connection receptacle could not be installed in the FIG. 11 connection receptacle due to interference with the body portion of the connection receptacle shape 1104.

Figure 12:
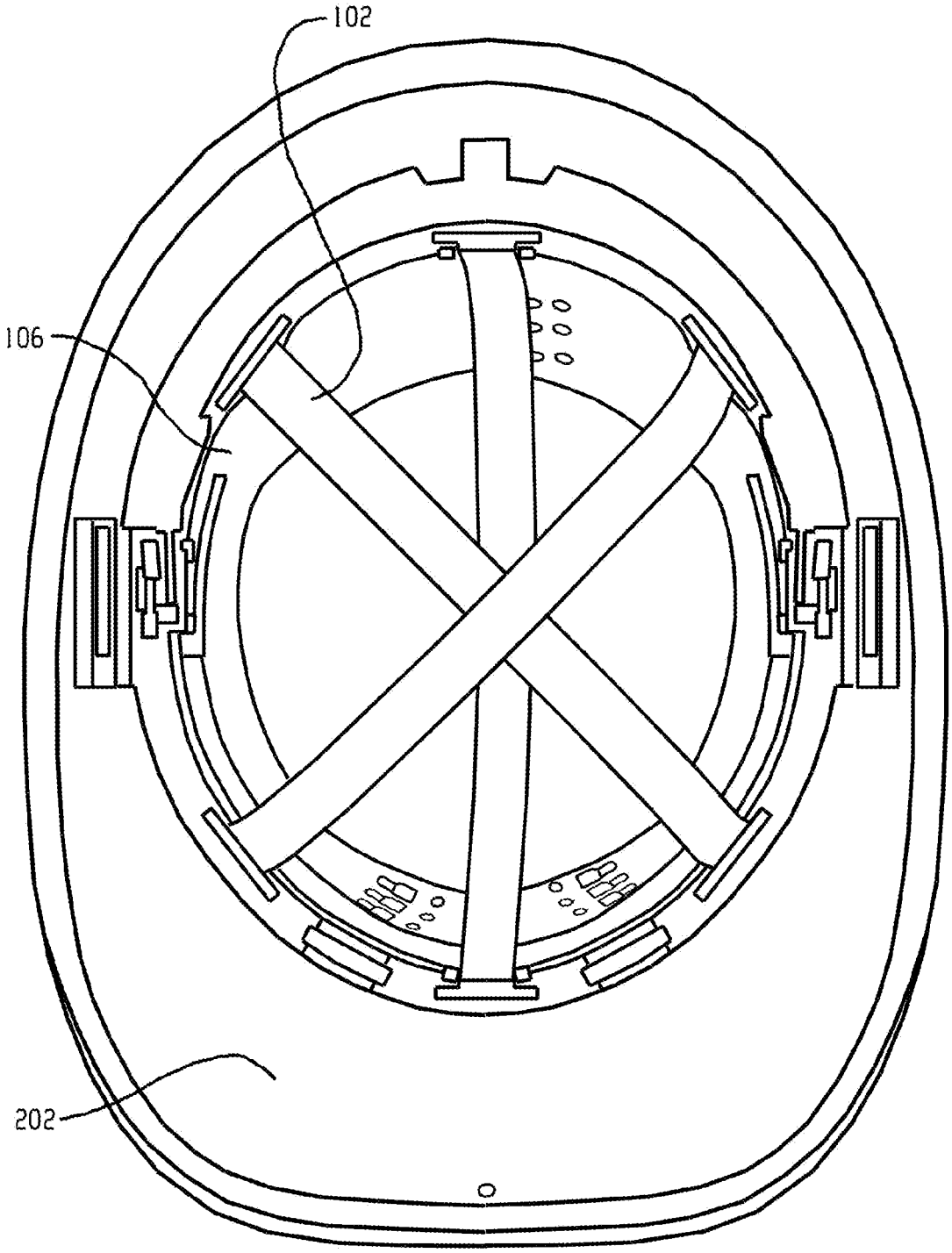
FIG. 12 depicts a suspension web installed into an inner liner of a helmet shell that is installed within a full brimmed fire helmet outer shell of the helmet shell.

FIG. 12 depicts a suspension web 102 installed into an inner liner 106 of a helmet shell that is installed within a full brimmed fire helmet outer shell 202 of the helmet shell. FIG. 12 illustrates features described above, including the limited accessibility of the body portion of connection tabs once installed into a helmet liner 106 that is further installed into an outer helmet shell 202. As illustrated in FIG. 12, a close fit between the inner liner 106 and the outer shell 202 inhibits a user from actuating the biased member to release connection tabs from connection receptacles. This may encourage users to disconnect the outer shell 202 from the inner shell 106 (e.g., for cleaning and/or replacement of the suspension web 102). This may further promote inspection and cleaning of other inner liner 106 and outer shell 202 surfaces and components that are not visible and accessible when those components 106, 202 are in their integrated state.

Figure 13:
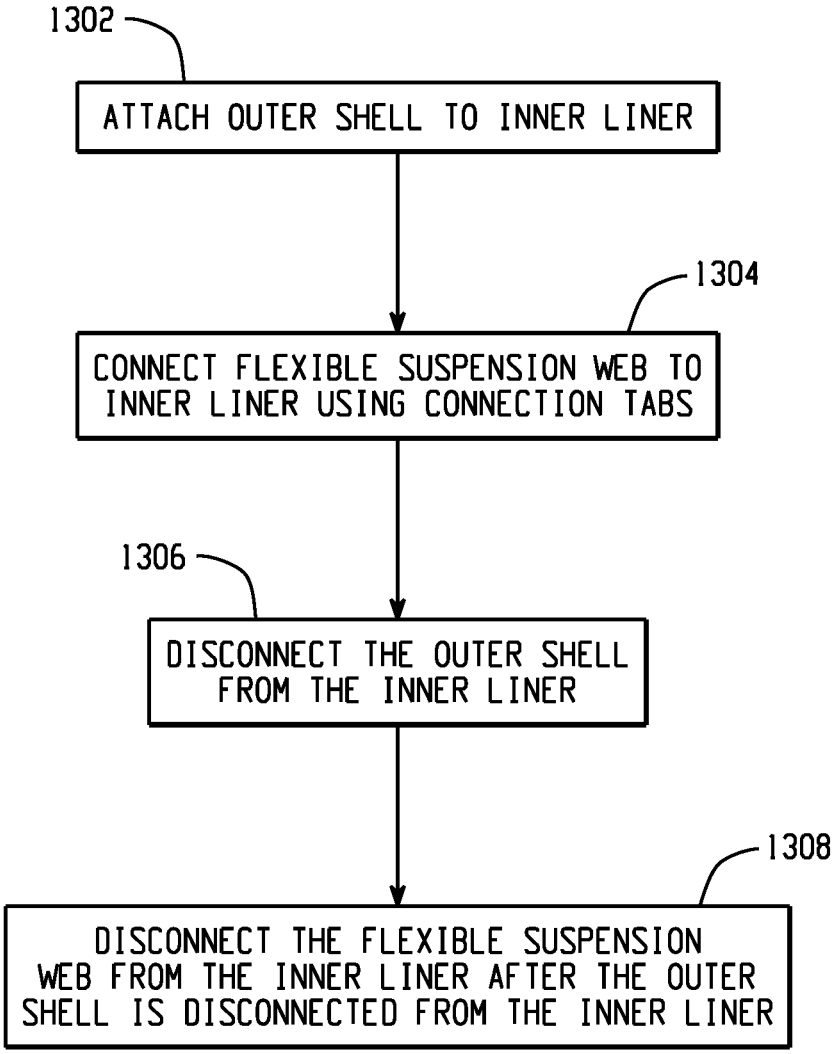
FIG. 13 is a flow diagram depicting a method of operating a helmet.

FIG. 13 is a flow diagram depicting a method of operating a helmet. The method includes attaching an outer shell to an inner liner at 1302 and connecting a flexible suspension web comprising a plurality of straps to the inner liner via connection tabs at 1304, each of the straps being associated with a connection tab, where a release mechanism of the connection tabs is inaccessible when the outer shell is attached to the inner liner. The outer shell is disconnected from the inner liner at 1306, and the flexible suspension web is disconnected from the inner liner at 1308 after the outer shell is disconnected from the inner liner.

Figure 14:
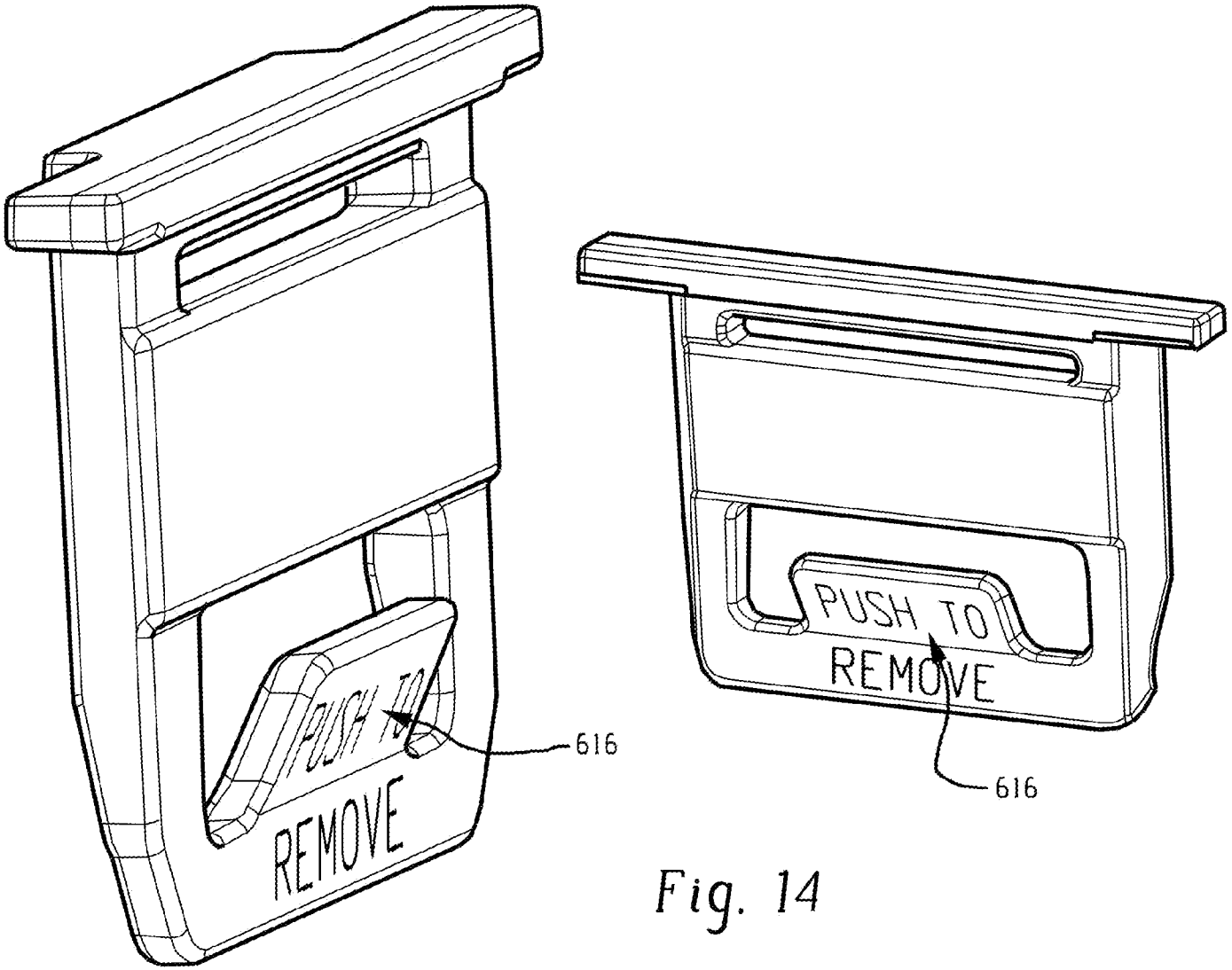
FIG. 14 depicts alternate form factors for connection tabs.

While the disclosure has been described in detail and with reference to specific embodiments thereof, it will be apparent to one skilled in the art that various changes and modifications can be made therein without departing from the spirit and scope of the embodiments. For example, FIG. 14 depicts alternate form factors for connection tabs, where the connection tabs of FIG. 14 include indicia for informing a user of proper operation of the biased members for removal of the connection tab from a connection receptacle. Thus, it is intended that the present disclosure cover the modifications and variations of this disclosure provided they come within the scope of the appended claims and their equivalents.

It is claimed:

1. A helmet, comprising;

an outer shell;

an inner liner comprising a plurality of connection receptacles, that includes:

a first connection receptacle having a first receptacle shape that comprises a first receptacle top portion and a first receptacle body portion; and a second connection receptacle having a second receptacle shape that comprises a second receptacle top portion and a second receptacle body portion;

wherein the first receptacle body portion and the second receptacle body portion are the same and a shape of the first receptacle top portion differs from a shape of the second receptacle top portion; and a flexible suspension web, the suspension web comprising:

a plurality of straps and a plurality of connection tabs wherein each of the plurality of straps includes a connection tab of the plurality of connection tabs;

wherein a first connection tab, which is associated with a first strap, has a first connection tab shape corresponding to the shape of the first receptacle top portion such that the first connection tab can be fully inserted into the first connection receptacle but not fully inserted into the second connection receptacle; and wherein a second connection tab, which is associated with a second strap, has a second connection tab shape corresponding to the shape of the second receptacle top portion such that the second connection tab can be fully inserted into the second connection receptacle but not fully inserted into the first connection receptacle.

2. The helmet of claim 1, wherein the first connection tab shape comprises a first connection tab body portion and a first connection tab top portion, and the second connection tab shape comprises a second connection tab body portion and a second connection tab top portion.

3. The helmet of claim 2, wherein a shape of the first receptacle body portion is configured to match a shape of the first connection tab body portion.

4. The helmet of claim 2, wherein the first connection tab body portion comprises a first release mechanism for disconnection manipulation.

5. The helmet of claim 4, wherein the first release mechanism comprises a first biased member that is configured to allow the first connection tab to pass back through the first connection receptacle during a disconnection manipulation.

6. The helmet of claim 5, wherein the first biased member is inaccessible for disconnection manipulation from the first connection receptacle until the outer shell is disconnected from the inner liner, exposing the first biased member for disconnection manipulation.

7. The helmet of claim 1, wherein the first connection tab comprises a first color, and wherein the second connection tab comprises a second color that is distinct from the first color.

8. The helmet of claim 7, wherein the first color is provided on the inner liner near the first connection receptacle and the second color is provided on the inner liner near the second connection receptacle.

9. The helmet of claim 1, wherein the plurality of straps are not all of uniform length, such that straps comprising connections tabs comprising the first connection tab shape are of different lengths than those of straps comprising connections tabs comprising the second connection tab shape.

10. The helmet of claim 1, wherein the plurality of connection tabs are keyed to the plurality of connection receptacles such that proper installation of the suspension web to the inner liner is promoted.

11. The helmet of claim 1, wherein a plurality of angles between the plurality of straps are configured such that proper fit of the helmet on a wearer is maintained.

12. The helmet of claim 1, wherein at least one of the plurality of straps comprises two or more connection tabs of the plurality of connection tabs.

13. The helmet of claim 1, wherein a first release mechanism of the first connection tab is sandwiched between the inner liner and the outer shell.

14. The helmet of claim 1, wherein each strap of the plurality of straps is paired with one other strap of the plurality of straps.

15. The helmet of claim 14, wherein each pair of straps comprises at least two connection tabs comprising the same connection tab shape.

16. The helmet of claim 14, wherein each pair of straps comprises at least two connection tabs comprising two different connection tab shapes.

17. The helmet of claim 1, wherein the plurality of straps extend radially from a central point such that the plurality of straps form a triangular, square, rectangular, or hexagonal arrangement.

18. The helmet of claim 1, wherein the first connection tab can only be fully inserted into the shape of the first receptacle top portion in a single orientation.

19. The helmet of claim 1, wherein the shape of the first receptacle top portion comprises a first receptacle length and a first receptacle top shape whose width varies along the first receptacle length, and the shape of the second receptacle top portion comprises a second receptacle length and a second receptacle top shape whose width varies along the second receptacle length, wherein the first receptacle length and the second receptacle length are the same and the first receptacle top shape differs from the second receptacle top shape.

20. The helmet of claim 19, wherein the width of the first receptacle top shape varies on exactly one side of the shape of the first receptacle top portion.

21. The helmet of claim 19, wherein the variation in width of the first receptacle top shape corresponds to at least one notch in the first receptacle top portion.

22. The helmet of claim 1, wherein interior walls of the first connection receptacle fully surround the first connection receptacle shape.

23. A helmet, comprising;

an outer shell;

an inner liner comprising a plurality of connection receptacles, that includes:

a first connection receptacle having a first receptacle shape that comprises a first receptacle top portion and a first receptacle body portion; and a second connection receptacle having a second receptacle shape that comprises a second receptacle top portion and a second receptacle body portion;

wherein the first receptacle top portion and the second receptacle top portion are the same and a shape of the first receptacle body portion differs from a shape of the second receptacle body portion; and a flexible suspension web, the suspension web comprising:

a plurality of straps and a plurality of connection tabs wherein each of the plurality of straps includes a connection tab of the plurality of connection tabs;

wherein a first connection tab, which is associated with a first strap, has a first connection tab shape corresponding to the shape of the first receptacle body portion such that the first connection tab can be fully inserted into the first connection receptacle but not fully inserted into the second connection receptacle; and wherein a second connection tab, which is associated with a second strap, has a second connection tab shape corresponding to the shape of the second receptacle body portion such that the second connection tab can be fully inserted into the second connection receptacle but not fully inserted into the first connection receptacle.

* * * * *